US007049763B2

(12) United States Patent
Hochi et al.

(10) Patent No.: US 7,049,763 B2
(45) Date of Patent: May 23, 2006

(54) ELECTRODELESS LOW-PRESSURE DISCHARGE LAMP OPERATING DEVICE AND SELF-BALLASTED ELECTRODELESS FLUORESCENT LAMP

(75) Inventors: Akira Hochi, Nara (JP); Takeshi Arakawa, Kyoto (JP); Kiyoshi Hashimotodani, Takatsuki (JP); Katsushi Seki, Ritto (JP); Yuuji Omata, Toyonaka (JP); Yoshihisa Hagiwara, Kobe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/516,221

(22) PCT Filed: May 30, 2003

(86) PCT No.: PCT/JP03/06902

§ 371 (c)(1),
(2), (4) Date: Nov. 30, 2004

(87) PCT Pub. No.: WO03/103012

PCT Pub. Date: Dec. 11, 2003

(65) Prior Publication Data

US 2005/0206322 A1 Sep. 22, 2005

(30) Foreign Application Priority Data

Jun. 3, 2002 (JP) ..... 2002-161907

(51) Int. Cl.
*H05B 41/16* (2006.01)
*H05B 41/24* (2006.01)

(52) U.S. Cl. ..... 315/248; 313/493

(58) Field of Classification Search ..... 315/246, 315/248, 224, 291, 56–62, 244; 313/479, 313/480, 485, 490, 493, 565, 547, 577
See application file for complete search history.

(56) References Cited

U.S. PATENT DOCUMENTS

| | | | | |
|---|---|---|---|---|
| 4,536,675 | A | 8/1985 | Postma | 313/46 |
| 6,522,084 | B1 * | 2/2003 | Miyazaki et al. | 315/248 |
| 6,650,068 | B1 * | 11/2003 | Kurachi et al. | 315/248 |
| 6,653,783 | B1 * | 11/2003 | Kawasaki et al. | 313/609 |
| 6,768,248 | B1 * | 7/2004 | Chandler et al. | 313/46 |
| 6,768,254 | B1 * | 7/2004 | Arakawa et al. | 313/493 |

FOREIGN PATENT DOCUMENTS

| | | |
|---|---|---|
| EP | 1 050 897 A2 | 8/2000 |
| JP | 55060260 A | 5/1980 |
| JP | 05-225960 | 9/1993 |
| JP | 6-6448 | 2/1994 |
| JP | 10112292 A | 4/1998 |

OTHER PUBLICATIONS

International Search Report for PCT/JP03/06902; ISA/JPO; Mailed: Sep. 9, 2003.

* cited by examiner

*Primary Examiner*—Wilson Lee
(74) *Attorney, Agent, or Firm*—Harness, Dickey & Pierce, P.L.C.

(57) ABSTRACT

An electrodeless discharge lamp operating device including a light-transmitting discharge bulb 120, an induction coil including a core 103 and a coil 104, and a ballast circuit 140 for supplying a high-frequency power to the induction coil. The operating frequency of the ballast circuit 140 is in the range of 80 kHz to 500 kHz, and where the operating frequency of the ballast circuit 140 is f (kHz) and the power input to the discharge bulb 120 is P (W), the rare gas pressure p (Pa) in the discharge bulb 120 satisfies the relationship of the following expression:

$$p \geq \sqrt{\frac{A}{P - \frac{B}{f^2} - C}}$$ [Expression 1]

(where A, B and C are constants having the following values: $A=4.0\times10^4$, $B=3.5\times10^4$ and $C=6.2$), and the power input P to the discharge bulb 120 is 7 W at minimum and 22 W at maximum.

8 Claims, 10 Drawing Sheets

FIG. 11

| Bulb① (Kr : 240Pa) | | Bulb② (Kr : 160Pa) | | Bulb③ (Kr : 140Pa) | | Bulb④ (Kr : 120Pa) | |
|---|---|---|---|---|---|---|---|
| f (kHz) | $P_{min}$ (W) | f (kHz) | $P_{min}$ (W) | f (kHz) | $P_{min}$ (W) | f (kHz) | $P_{min}$ (W) |
| 117.3 | 10.86 | 135.8 | 11.18 | 145.5 | 11.41 | 145.2 | 11.56 |
| 129.2 | 10.45 | 129.0 | 11.80 | 136.1 | 12.05 | 129.1 | 12.22 |
| 144.6 | 10.01 | 127.5 | 11.77 | 128.7 | 11.99 | 116.8 | 12.84 |
| 92.6 | 12.15 | 116.1 | 12.30 | 117.0 | 12.48 | 106.0 | 13.54 |
| 97.8 | 11.84 | 107.0 | 12.75 | 106.8 | 13.22 | 100.7 | 13.98 |
| 103.0 | 11.37 | 136.7 | 11.06 | 105.3 | 13.37 | 94.3 | 14.32 |
| 123.5 | 10.45 | 128.0 | 11.77 | 100.9 | 13.84 | 136.2 | 11.93 |
| 137.0 | 10.27 | 122.5 | 11.79 | 95.1 | 14.44 | 123.2 | 12.39 |
| 91.9 | 12.35 | 116.3 | 12.16 | 137.7 | 11.79 | 103.0 | 13.50 |
| 103.1 | 11.33 | 103.3 | 12.70 | 129.2 | 11.98 | 97.7 | 14.01 |
| 110.8 | 10.93 | 120.9 | 11.97 | 117.6 | 12.69 | 112.1 | 12.74 |
| 120.8 | 10.65 | 114.9 | 12.23 | 103.6 | 13.49 | 104.6 | 13.32 |
| 98.1 | 11.55 | 111.3 | 12.17 | 98.3 | 13.67 | 97.6 | 13.53 |
| 105.2 | 11.43 | 106.4 | 12.68 | 92.6 | 14.41 | | |
| 112.7 | 11.08 | 103.8 | 12.84 | 121.0 | 12.30 | | |
| | | 95.9 | 13.29 | 111.1 | 12.83 | | |
| | | 118.0 | 12.04 | 103.3 | 13.26 | | |
| | | 112.5 | 12.25 | 92.0 | 14.16 | | |
| | | 108.1 | 12.22 | 112.7 | 12.77 | | |
| | | 103.9 | 12.78 | 104.6 | 13.10 | | |
| | | 101.0 | 12.95 | 98.3 | 13.39 | | |
| | | 112.2 | 12.13 | | | | |
| | | 107.2 | 12.51 | | | | |
| | | 104.5 | 12.80 | | | | |
| | | 97.9 | 13.00 | | | | |
| | | 104.2 | 12.56 | | | | |
| | | 100.5 | 12.70 | | | | |
| | | 97.4 | 12.85 | | | | |
| | | 92.5 | 13.32 | | | | |
| | | 100.2 | 12.90 | | | | |
| | | 97.4 | 12.96 | | | | |
| | | 93.8 | 13.03 | | | | |
| | | 89.8 | 13.54 | | | | |

FIG. 12

| Light-emitting bulbNo. | p(Pa) | f(kHz) | $P_{min}$(W) |
|---|---|---|---|
| Bulb⑤ | 350 | 423.1 | 7.91 |
| Bulb⑥ | 300 | 423.1 | 8.13 |
| Bulb⑦ | 250 | 422.3 | 8.80 |
| Bulb⑧ | 250 | 423.8 | 8.60 |
| Bulb⑨ | 200 | 422.6 | 9.32 |

ELECTRODELESS LOW-PRESSURE DISCHARGE LAMP OPERATING DEVICE AND SELF-BALLASTED ELECTRODELESS FLUORESCENT LAMP

TECHNICAL FIELD

The present invention relates to an electrodeless low-pressure discharge lamp, and more particularly to a self-ballasted electrodeless fluorescent lamp.

BACKGROUND ART

Due to the absence of electrodes, electrodeless fluorescent lamps have longer lifetimes than fluorescent lamps with electrodes, and have efficiencies as high as those of common fluorescent lamps. With such characteristics, electrodeless fluorescent lamps have been drawing public attention from the point of view of environmental protection and economic efficiency, and have a potential for becoming more and more widespread in the future. Electrodeless fluorescent lamps are demanded primarily as an alternative light source replacing incandescent lamps, which have been widely used in general lighting. Where electrodeless fluorescent lamps are used for this purpose, they are required to be as compact as incandescent lamps, have high lamp efficiencies and be economical.

Electrodeless fluorescent lamps, having higher efficiencies and longer lifetimes than fluorescent lamps with electrodes, can be suitable light sources. For example, commercially-available electrodeless fluorescent lamps use operating frequencies in a MHz frequency range such as 13.56 MHz, being an ISM band, the rated power of these lamps is about 25 W to 150 W, and the lifetime thereof is 15,000 to 60,000 hours. It has been shown that they have desirable maintainability and efficiency.

These electrodeless fluorescent lamps that are being sold in the market today are primarily used for lighting at locations where replacing lamps requires a high cost, such as landscape lighting, street lighting, bridge lighting, public park lighting, lighting for factories with high ceilings, etc., and most of them use separate ballast circuits.

In recent years, self-ballasted electrodeless fluorescent lamps have been developed in the art that can be plugged into incandescent-lamp sockets and used as if they were incandescent lamps, while retaining the advantageous characteristics of electrodeless fluorescent lamps such as the high efficiencies and long lifetimes. Discussions have been made on widely spreading self-ballasted electrodeless fluorescent lamp having such advantageous characteristics as an alternative light source replacing incandescent lamps. Specifically, self-ballasted electrodeless fluorescent lamps including a discharge bulb and a ballast circuit integrated as one unit have been developed in the art and expected to become widespread, which can be plugged into incandescent-lamp sockets so that they can be used as an alternative light source replacing incandescent lamps at locations where incandescent lamps have conventionally been used, such as hotels, restaurants and houses.

The electrodeless fluorescent lamps required as an incandescent lamp replacement, unlike those used for public outdoor lighting, are those that have a luminous flux equivalent to that of an incandescent lamp of 60 W to 100 W and have a wattage of about 10 W to 20 W. There is a demand for these low-wattage electrodeless fluorescent lamps as an incandescent lamp replacement to not only have long lifetimes but also be compact, readily acceptable pricewise, and free of electromagnetic interference (EMI) with surrounding electric appliances.

A primary object of the present invention, which has been made in view of the above, is to provide an electrodeless discharge lamp operating device that exhibits desirable characteristics (particularly, maintaining a stable discharge) even in an electrodeless discharge lamp operating device in which electromagnetic interference (EMI) is suppressed.

DISCLOSURE OF THE INVENTION

An electrodeless low-pressure discharge lamp operating device of the present invention includes: a light-transmitting discharge bulb filled with a rare gas including at least krypton and mercury; an induction coil including a core and a coil wound around the core for generating an electromagnetic field inside the discharge bulb; and a ballast circuit for supplying a high-frequency power to the induction coil, wherein: an operating frequency of the ballast circuit is in a range of 80 kHz to 500 kHz, and where the operating frequency of the ballast circuit is f (kHz) and a power input to the discharge bulb is P (W), a pressure p (Pa) of the rare gas in the discharge bulb satisfies a relationship of a following expression:

$$p \geq \sqrt{\frac{A}{P - \frac{B}{f^2} - C}} \qquad \text{[Expression 1]}$$

(where A, B and C are constants having the following values: $A=4.0\times10^4$, $B=3.5\times10^4$ and $C=6.2$); and the power input P to the discharge bulb is 7 W at minimum and 22 W at maximum.

Herein, the "low pressure" as in the "electrodeless low-pressure discharge lamp operating device" means that the pressure in the discharge bulb is lower than that of an HID lamp (High Intensity Discharge lamp), e.g., a high-pressure mercury lamp or a high-pressure sodium lamp. Specifically, it means that the pressure of the substance filled in the discharge bulb during the stable operation period is 1 kPa or less.

A self-ballasted electrodeless fluorescent lamp of the present invention includes: a light-transmitting discharge bulb filled with a rare gas including at least krypton and mercury; an induction coil including a core and a coil wound around the core and being inserted into a cavity portion provided in a portion of the discharge bulb; a ballast circuit for supplying a high-frequency power to the induction coil; and a base electrically connected to the ballast circuit, wherein: an operating frequency of the ballast circuit is in a range of 80 kHz to 500 kHz, and where the operating frequency of the ballast circuit is f (kHz) and a power input to the discharge bulb is P (W), a pressure p (Pa) of the rare gas in the discharge bulb satisfies a relationship of a following expression:

$$p \geq \sqrt{\frac{A}{P - \frac{B}{f^2} - C}} \qquad \text{[Expression 1]}$$

(where A, B and C are constants having the following values: $A=4.0\times10^4$ $B=3.5\times10^4$ and $C=6.2$); and the power input P to the discharge bulb is 7 W at minimum and 22 W at maximum.

In one embodiment, the core of the induction coil contains iron, manganese and zinc.

In one embodiment, the rare gas filled in the discharge bulb includes argon; and the argon is 10% or more and 50% or less of the rare gas.

BRIEF DESCRIPTION OF THE DRAWINGS

FIG. 11 is a table showing the discharge maintaining power values obtained from the gas pressure and the operating frequency.

FIG. 12 is a table showing the relationship between the gas pressure and the discharge maintaining power where the operating frequency is 423 kHz.

BEST MODE FOR CARRYING OUT THE INVENTION

Figure 1:
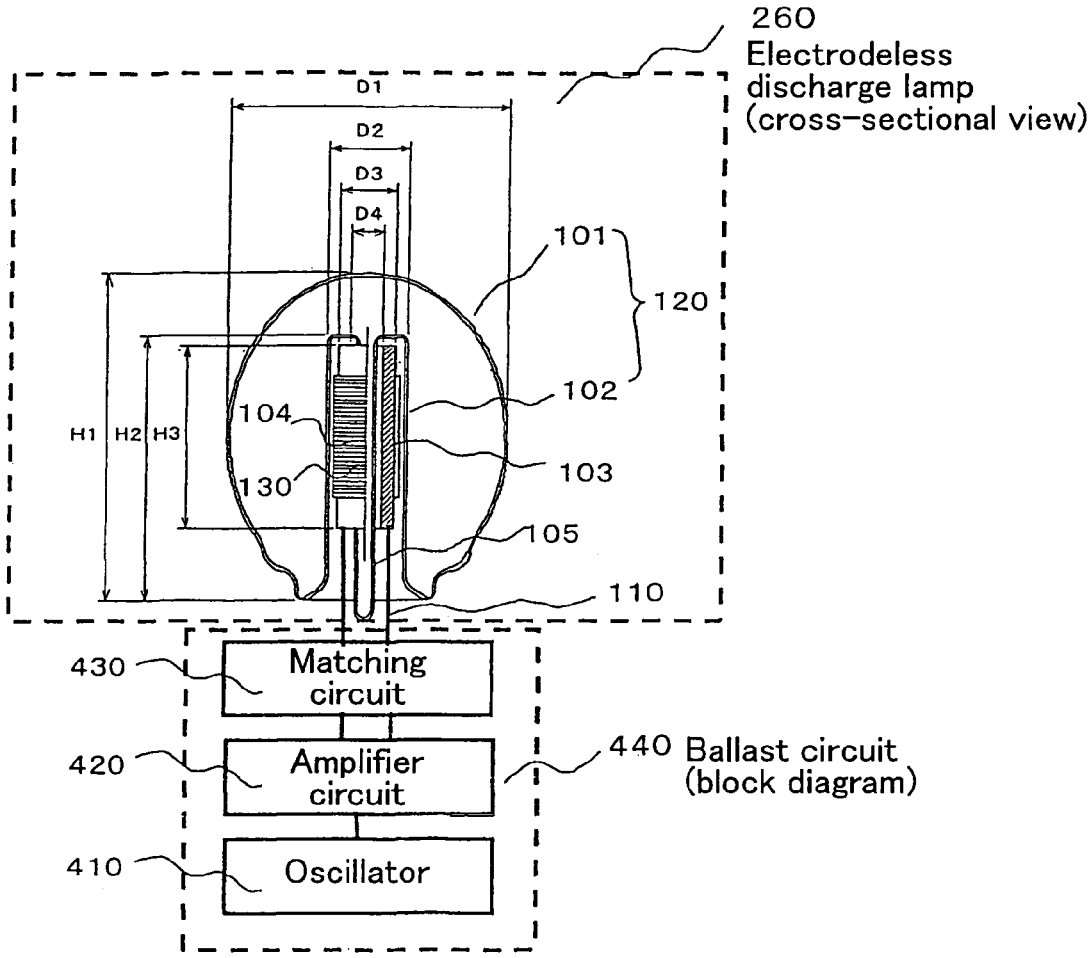
FIG. 1 is a schematic diagram illustrating a testing device for testing electrodeless discharge lamp operating characteristics.

Before describing an embodiment of the present invention, basic researches performed by the present inventors before completing the invention will be described, after which an electrodeless low-pressure discharge lamp operating device and a self-ballasted electrodeless fluorescent lamp according to the embodiment of the present invention will be described. Note that the terms "electrodeless discharge lamp" and "electrodeless discharge lamp operating device" will hereinafter refer to an "electrodeless low-pressure discharge lamp" and an "electrodeless low-pressure discharge lamp operating device", respectively.

In order to develop an electrodeless fluorescent lamp as an incandescent lamp replacement primarily for use in hotels, houses, etc., the present inventors produced and lit prototypes of low-wattage electrodeless fluorescent lamps with operating frequencies of 500 kHz or less and wattages of 20 W or less for characteristics evaluation and visual observation thereof. As a result, it was revealed that an unexpected phenomenon occurs that had not been observed with high-wattage (e.g., 150 W) electrodeless discharge lamps used primarily outdoors. The phenomenon is as follows. In a low-wattage electrodeless fluorescent lamp in which the input power to the discharge bulb is about 10 W to 20 W, when the buffer gas pressure is set to a value of about 40 to 50 (Pa), which is a value used in a high-wattage (e.g., 150 W) electrodeless discharge lamp, the discharge is likely to be very unstable and the lamp cannot be operated in some cases.

Then, the present inventors produced prototypes of low-wattage electrodeless discharge lamps aiming at avoiding such a phenomenon, and obtained conditions under which the lamps can be prevented from flickering or going out and a stable discharge can be maintained, thus completing the present invention.

The researches performed by the present inventors will be described below in detail. Where the type of the gas to be filled in and the shape of the discharge bulb are given, whether or not a discharge in an electrodeless discharge lamp can be maintained is dependent primarily on the pressure p of the fill gas and the electric field strength E in the discharge bulb. Under a condition where a discharge is being maintained, it can be considered that the product $n_n \cdot \nu_e$ between the number $n_n$ of neutral particles in the discharge bulb and the electron collision frequency $\nu_e$ is substantially constant or, in other words, the product pE between the rare gas pressure p and the electric field strength E is substantially constant. Thus, with an increased pressure p of the rare gas to be filled in, it is possible to maintain a discharge even with a low electric field strength E.

Moreover, the relationship between the power input P to the discharge bulb of an electrodeless discharge lamp and the electric field strength E can be given by the following expression:

$$P_{in} \approx \sigma E^2 = \frac{e^2 n_e}{m_e V_e} \cdot E^2 \qquad \text{[Expression 2]}$$

where σ is the conductivity, e the electron charge, $n_e$ the electron density, and $m_e$ the mass of an electron.

As can be seen based on this expression and that the product pE between the rare gas pressure p and the electric field strength E can be considered substantially constant, the following expression is obtained:

$$P_{\min} \propto \frac{1}{p^2} \qquad \text{[Expression 3]}$$

for the minimum power input $P_{min}$ required for maintaining a discharge (hereinafter referred to simply as the "discharge maintaining power") and the rare gas pressure p.

Moreover, the electric field strength E in the discharge bulb based on the induced magnet field produced by an induction coil of an electrodeless discharge lamp operating device is proportional to the frequency of the induced current, i.e., the operating frequency f of the electrodeless discharge lamp operating device. Thus, the relationship between the discharge maintaining power $P_{min}$ (W) of the electrodeless discharge lamp and the operating frequency f thereof is given by the following expression:

$$P_{\min} \propto \frac{1}{f^2} \quad \text{[Expression 4]}$$

The present inventors derived, based on Expression 3 and Expression 4 above, that the discharge maintaining power $P_{min}$ (W) of an electrodeless discharge lamp can be approximated as shown in Expression 5 below:

$$P_{\min} = A\frac{1}{p^2} + B\frac{1}{f^2} + C \quad \text{[Expression 5]}$$

where p (Pa) is the rare gas pressure, and f (kHz) the operating frequency. Herein, A, B and C are constants.

As can be seen from Expression 5, the value of the discharge maintaining power $P_{min}$ increases as the rare gas pressure p is lowered. This means that with lamps of lower wattages, it becomes more difficult to maintain a discharge as the rare gas pressure is lowered. Thus, it can be understood qualitatively that while a stable discharge can be maintained even when the krypton gas pressure is set to 40 to 50 Pa with commercially-available high-wattage-type (e.g., 100 W) electrodeless fluorescent lamps, a discharge may become unstable or difficult to be maintained under such a low gas pressure with low-wattage (e.g., 13 W) electrodeless discharge lamps. It can also be seen that phenomena such as flickering are even more likely to occur with electrodeless discharge lamps in which the operating frequency is lowered to be about a few 100 kHz, as an EMI countermeasure, from the MHz range, which is used for conventional electrodeless discharge lamps.

In view of this, the present inventors produced prototypes of electrodeless discharge lamps as an incandescent lamp replacement, and conducted experiments to examine how the discharge maintaining power $P_{min}$ changes as the fill gas pressure and the operating frequency of the ballast circuit are varied. The details of such an experiment as an example will now be described, together with the conditions and results of the experiment.

FIG. 1 is a basic configuration diagram of a testing device for examining the operating characteristics of the electrodeless discharge lamp used in the present experiment. The testing device illustrated in FIG. 1 includes an electrodeless discharge lamp 260 and a ballast circuit 440.

The electrodeless discharge lamp 260 includes a light-transmitting discharge bulb 120 and an induction coil 130. The induction coil 130 is a member for supplying a high-frequency power from the ballast circuit 440 to the discharge bulb 120.

As illustrated in FIG. 1, the discharge bulb 120 includes an outer tube 101 and an inner tube 102, with an exahust tube 105 connected to the inner tube 102. Mercury and krypton as a rare gas (not shown) are filled in the discharge bulb 120, and a phosphor layer (not shown) is formed by phosphor coating on the inside of the discharge bulb 120. The phosphor layer serves to convert, to a visible light radiation, an ultraviolet radiation generated through the excitation of mercury filled in the discharge bulb 120.

The induction coil 130 is provided between the inner tube 102 of the discharge bulb 120 and the exahust tube 105. The induction coil 130, made of a magnetic material (soft magnetic material), includes a generally tubular ferrite core 103 and a winding 104. The winding 104 is connected to the ballast circuit 440, which is a circuit for supplying a high-frequency current to the induction coil 130.

Note that the outer tube 101 of the discharge bulb used in the present experiment has a diameter D1 of 65 mm and a height H1 of 75 mm, and the inner tube 102 has an outer diameter D2 of 20 mm and a height H2 of 63 mm. Moreover, the core 103 of the induction coil 130 has a length H3 of 55 mm, an outer diameter D3 of 14 mm and an inner diameter D4 of 6 mm, and the number of turns of the winding 104 is 66.

As illustrated in FIG. 1, the ballast circuit 440 includes an oscillator 410, an amplifier circuit 420 and a matching circuit 430. The oscillator 410 functions to set the frequency of the high-frequency power supplied to the discharge bulb 120, the amplifier circuit 420 functions to amplify the power from the oscillator 410, and the matching circuit 430 functions to match the output from the amplifier circuit 420 with the impedance of the electrodeless discharge lamp 260.

In the present experiment, the operating frequency of the ballast circuit 440 was set by the oscillator 410 to a frequency in the range of 100 kHz to 140 kHz and the pressure of the krypton gas filled in as a rare gas was varied over the range of 120 Pa to 240 Pa, so as to obtain the minimum power required to be supplied to the discharge bulb 120 for maintaining a stable discharge, i.e., the discharge maintaining power $P_{min}$ (W), for each combination of the operating frequency of the gas pressure. The discharge maintaining power $P_{min}$ as used herein includes not only the power consumed by a discharge plasma but also the power loss through the induction coil 130, and is the power supplied to the induction coil (the power is hereinafter referred to as "the power input to the discharge bulb").

FIG. 11 shows an example of the results of the present experiment. FIG. 11 shows the values of the discharge maintaining power $P_{min}$ (W) where the operating frequency f of the ballast circuit 440 was varied over the range of about 90 kHz to 145 kHz while the pressure p of the krypton gas filled in the discharge bulb 120 was set to 120, 140, 160 or 240 Pa.

Figure 2:
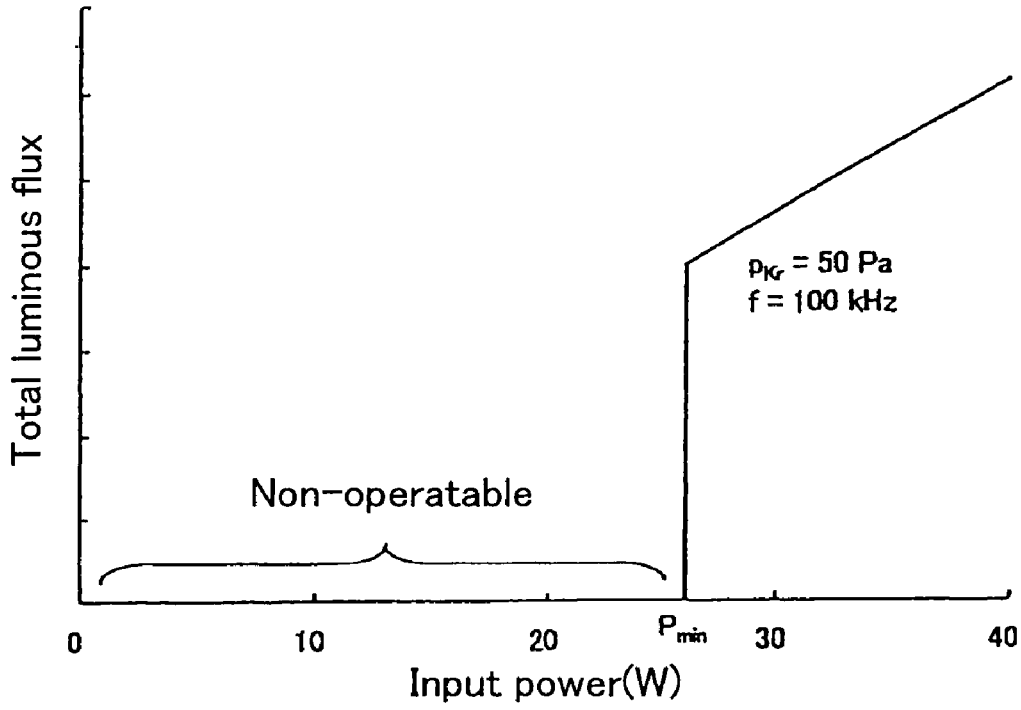
FIG. 2 is a graph illustrating the relationship between the input power and the total luminous flux.

$P_{min}$ (W) in FIG. 11 can be obtained as shown in FIG. 2. For example, where the pressure p of the krypton gas is 50 Pa and the operating frequency of the ballast circuit 440 is 100 kHz, the correlation between the input power and the total luminous flux is as shown in FIG. 2, whereby the discharge maintaining power $P_{min}$ (W) can be obtained. As the power is lowered, the total luminous flux gradually decreases, and it becomes no longer possible to maintain a discharge at a particular point, with the total luminous flux becoming 0 eventually. $P_{min}$ (W) is the input power at this particular point. Even a person skilled in the art cannot know the point where a discharge can no longer be maintained, except through actual measurement. $P_{min}$ (W) is a critically significant point because the total luminous flux sharply decreases past $P_{min}$ (W).

As shown in FIG. 11, the present experiment proved that while a stable discharge can be maintained even when the krypton gas pressure is set to 40 to 50 Pa with commercially-available high-wattage-type (e.g., 100 W) electrodeless fluorescent lamps, it is difficult to maintain a discharge with such a low gas pressure with electrodeless discharge lamps in which a low-wattage (e.g., about 10 W) power is input to the discharge bulb.

The results shown in FIG. 11 will now be discussed in detail. Based on the results shown in FIG. 11, the discharge maintaining power $P_{min}$ (W) where the operating frequency is constant, e.g., 100 kHz, is about 13.8 W for a krypton gas pressure of 120 Pa and about 11.6 W for a krypton gas pressure of 240 Pa. Thus, it can be seen that as the pressure p of the krypton gas decreases, the discharge maintaining power $P_{min}$ monotonically increases with the decrease in the pressure p. This tendency also applies when the operating frequency is 120 or 140 kHz, where the discharge maintaining power $P_{min}$ decreases as the operating frequency f is increased.

Now, the experimental results will be discussed from the point of view of designing an electrodeless fluorescent lamp. Consider a case where an electrodeless discharge lamp having an emission power equivalent to that of a self-ballasted electrodeless fluorescent lamp of 60 W is designed with an operating frequency of 100 kHz and a krypton fill gas pressure of 120 Pa. Then, since the discharge maintaining power at 100 kHz and 120 Pa is about 13.8 W based on the results shown in FIG. 11, it can be seen that it is impossible to design an electrodeless discharge lamp of 10 W equivalent to an incandescent lamp of 60 W. Using the results of FIG. 11, it can be seen that the operating frequency and the krypton gas pressure can be set to, for example, 140 kHz and 240 Pa, respectively, in order to produce an electrodeless fluorescent lamp equivalent to an incandescent lamp of 60 W.

As another example, the conditions and results of another experiment will now be described.

A testing device for examining the operating characteristics of the electrodeless discharge lamp used in the present experiment has the same basic configuration as that used in the experiment described above, including the ballast circuit 440. Thus, the description of the common parts will not be repeated for the sake of simplicity. The details of the electrodeless discharge lamp 260 used in the present experiment will now be described.

The outer tube 101 of the discharge bulb 120 has a diameter D1 of 65 mm and a height H1 of 75 mm, and the inner tube 102 has an outer diameter D2 of 25.5 mm and a height H2 of 63 mm. Moreover, the core 103 of the induction coil 130 has a length of 55 mm, an outer diameter D3 of 15.5 mm and an inner diameter D4 of 8.5 mm, and the number of turns of the winding 104 is 42. In this lamp, a heatsink is provided. Also in the example described above, the lamp is provided with a heatsink.

In this experiment, five prototypes of the electrodeless discharge lamp 260 were produced each having a krypton fill gas pressure p in the range of 200 Pa to 350 Pa, and the lamps were lit at an operating frequency f of 423 kHz (constant), so as to obtain the discharge maintaining power $P_{min}$ (W) of the electrodeless discharge lamp 260 for each gas pressure p. FIG. 12 shows an example of the results of this experiment.

Where the operating frequency was set to 423 kHz, the discharge maintaining power $P_{min}$ of the electrodeless discharge lamp 260 was 9.3 W for a krypton gas pressure of 200 Pa and 7.9 W for a krypton gas pressure of 350 Pa, indicating that the discharge maintaining power $P_{min}$ was higher as the gas pressure p was lower. This is a similar tendency to that seen in the results of the previous experiment. Moreover, it was found that as compared with the previous experiment, the discharge maintaining power decreases more significantly as the operating frequency is increased.

Based on the results of the two experiments described above, the following approximate expression was derived, which represents the relationship of the discharge maintaining power $P_{min}$ (W) with respect to the krypton gas pressure p (Pa) and the operating frequency f (kHz).

$$P_{\min} = A\frac{1}{p^2} + B\frac{1}{f^2} + C \qquad \text{[Expression 5]}$$

Note that the constants A, B and C were derived by the method of least squares to be $A=4.0\times10^4$, $B=3.5\times10^4$ and $C=7.7$.

Figure 3:
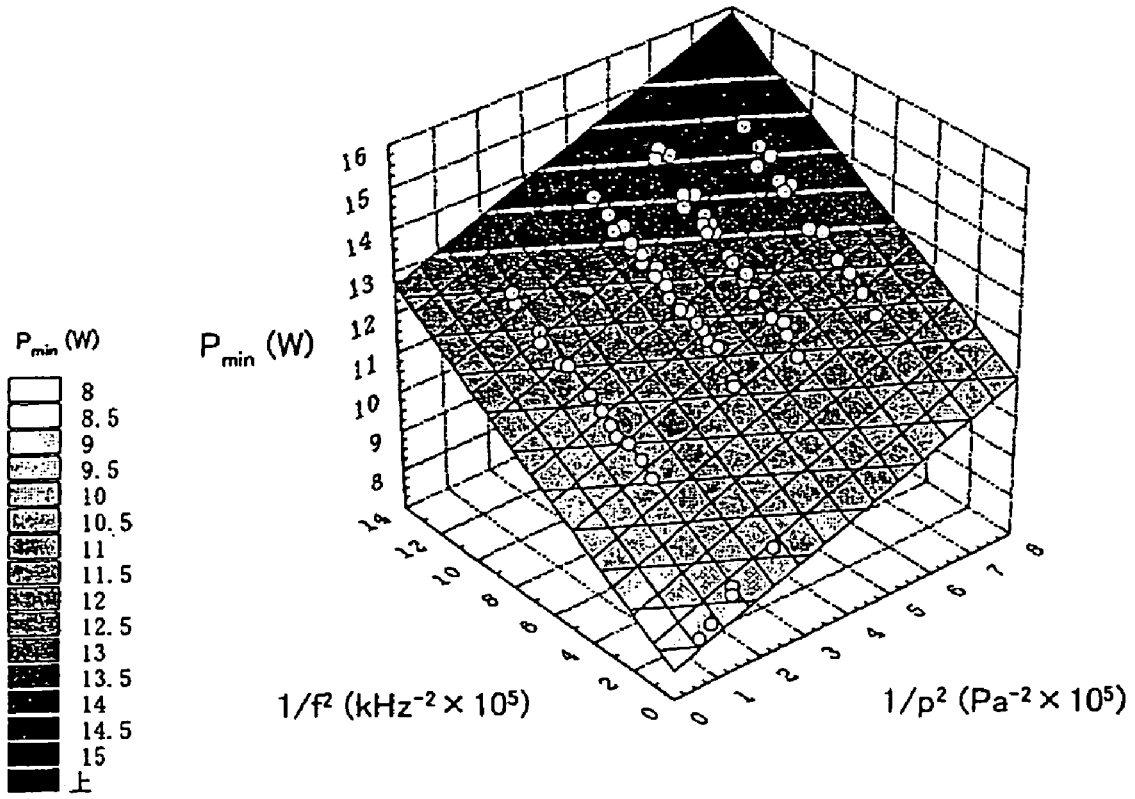
FIG. 3 is a three-dimensional plot of the discharge maintaining power $P_{min}$ with respect to the gas pressure p and the operating frequency f.
Figure 4:
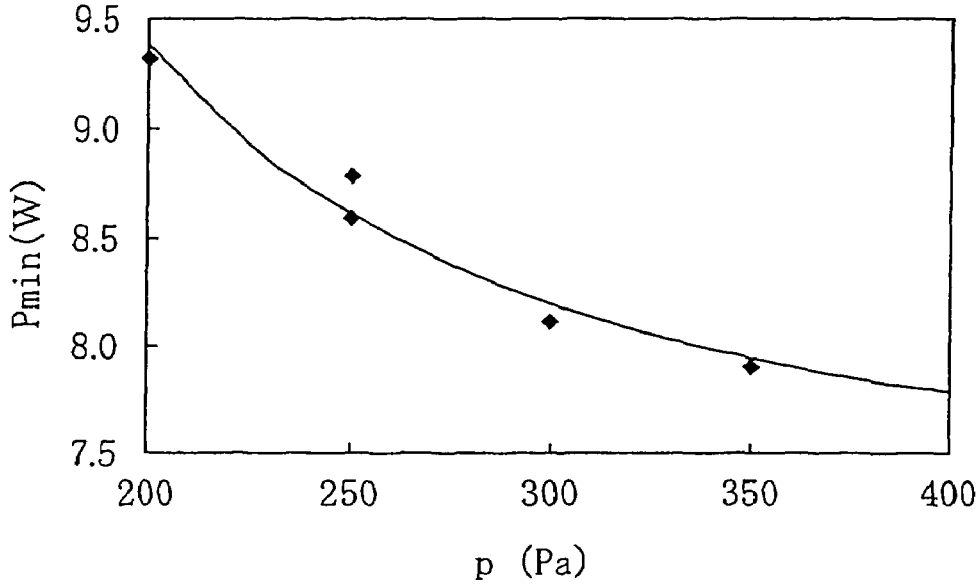
FIG. 4(*a*) is a graph illustrating the relationship between the gas pressure p and the discharge maintaining power $P_{min}$, and FIG. 4(*b*) is a graph illustrating the relationship between $1/p^2$ and the discharge maintaining power $P_{min}$.
Figure 4:
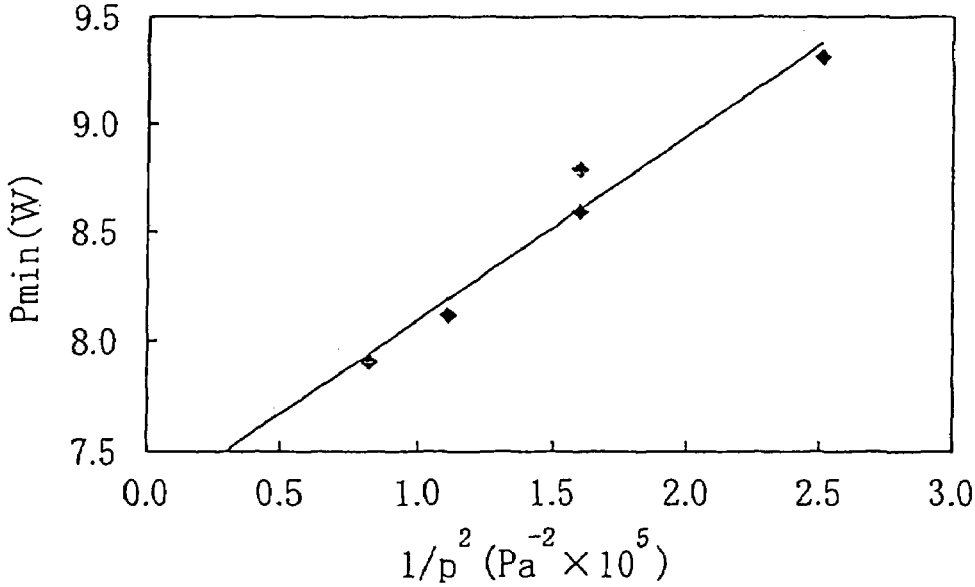

FIG. 3 shows a three-dimensional plot of the data used for deriving Expression 5, where the x axis represents $1/p^2$, the y axis represents $1/f^2$, and the z axis represents the discharge maintaining power $P_{min}$. As a reference, FIG. 4(*a*) and FIG. 4(*b*) each show a two-dimensional plot based on the data shown in FIG. 12.

It can be seen from FIG. 3 that the data points are nicely arranged along the plane of Expression 5 representing the discharge maintaining power $P_{min}$. Note that this plane is a critically significant plane distinguishing the "operatable" area and the "non-operatable" area from each other.

By using Expression 5, it is possible to obtain the minimum pressure $p_{min}$ (Pa) of the krypton gas required for designing an electrodeless discharge lamp operating device, where P (W) is the power input to the discharge bulb 120 and f (kHz) is the operating frequency of the ballast circuit. Specifically, the minimum pressure $p_{min}$ (Pa) of the krypton fill gas can be obtained by substituting $P_{min}$ (W) and f in Expression 5 with the value of the power input P (W) to the discharge bulb 120 and the value of the operating frequency f (kHz), respectively, and then solving the expression with respect to p.

Thus, based on Expression 2, where the power input to the discharge bulb 120 of the electrodeless discharge lamp operating device is P (W) and the device is operated at the operating frequency f (kHz), the pressure p (Pa) of the krypton gas filled in the discharge bulb should satisfy the following expression.

$$p \geq p_{\min} = \sqrt{\frac{A}{P - \frac{B}{f^2} - C}} \qquad \text{[Expression 6]}$$

(where $A=4.0\times10^4$, $B=3.5\times10^4$ and $C=7.7$)

A measurement of the discharge maintaining power $P_{min}$ with prototypes of electrodeless discharge lamps with a ballast circuit (inverter circuit) used in practice showed that the discharge maintaining power $P_{min}$ in actual electrodeless discharge lamps was lower by about 1.5 W overall than the value obtained by the experiments described above. Therefore, when designing an actual electrodeless discharge lamp, it is convenient to use the following expression, which is similar to Expression 6 but with a correction to C=6.2.

$$p \geq \sqrt{\frac{A}{P - \frac{B}{f^2} - C}}$$ [Expression 1]

(where $A=4.0\times10^4$, $B=3.5\times10^4$ and $C=6.2$)

Figure 5:
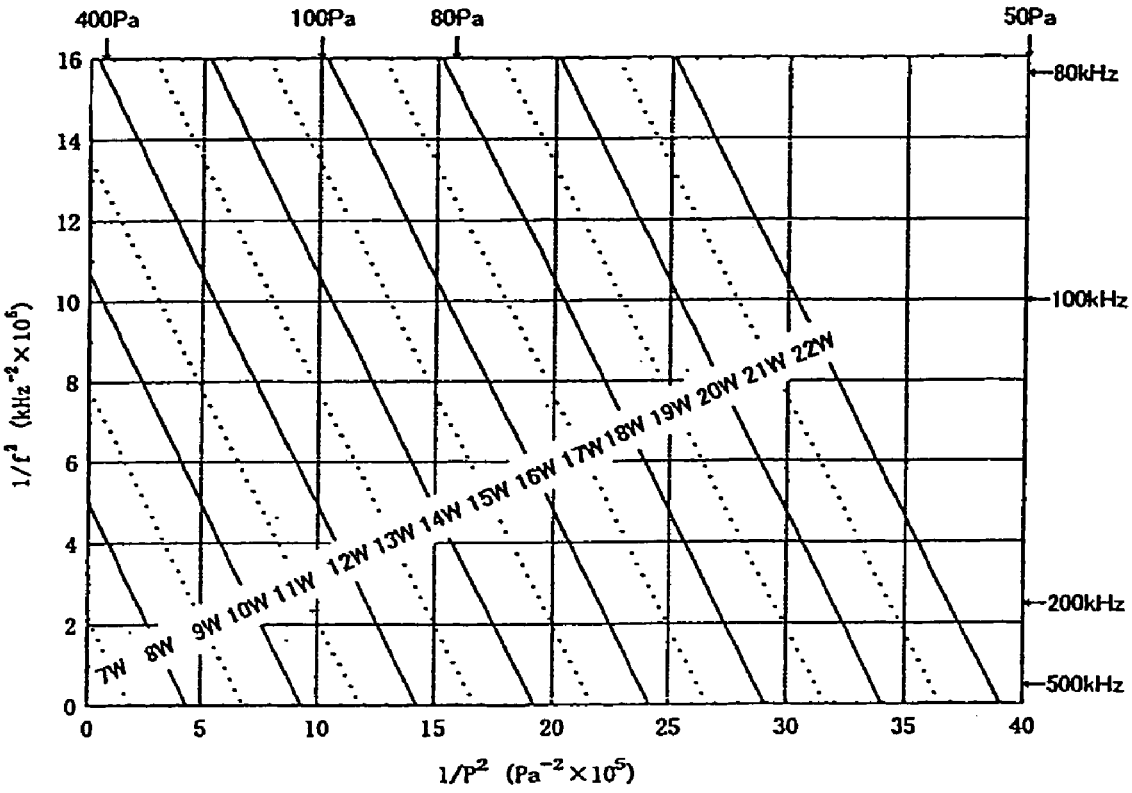
FIG. 5 is a contour map of the discharge maintaining power $P_{min}$ with respect to the gas pressure p and the operating frequency f.

FIG. 5 is a graphic representation of Expression 5. Specifically, it is a plot of the contour line of the discharge maintaining power $P_{min}$, where the horizontal axis represents $1/p^2$, an inverse square of the pressure, and the vertical axis represents $1/f^2$, an inverse square of the frequency. Based on FIG. 5, once two of the wattage of the electrodeless discharge lamp being designed, the rare gas pressure p and the operating frequency f are set, the value of the remaining parameter can be obtained.

Note that when obtaining the value $P_{min}$ of the minimum pressure of the krypton gas using Expression 1 in an actual design, it is needed to be set to a value with some allowance taking into consideration the fluctuation of the power supply voltage, the characteristics degradation due to aging in the electronic components used in the ballast circuit, etc.

An embodiment of the present invention, which is based on the research results described above, will now be described.

Figure 6:
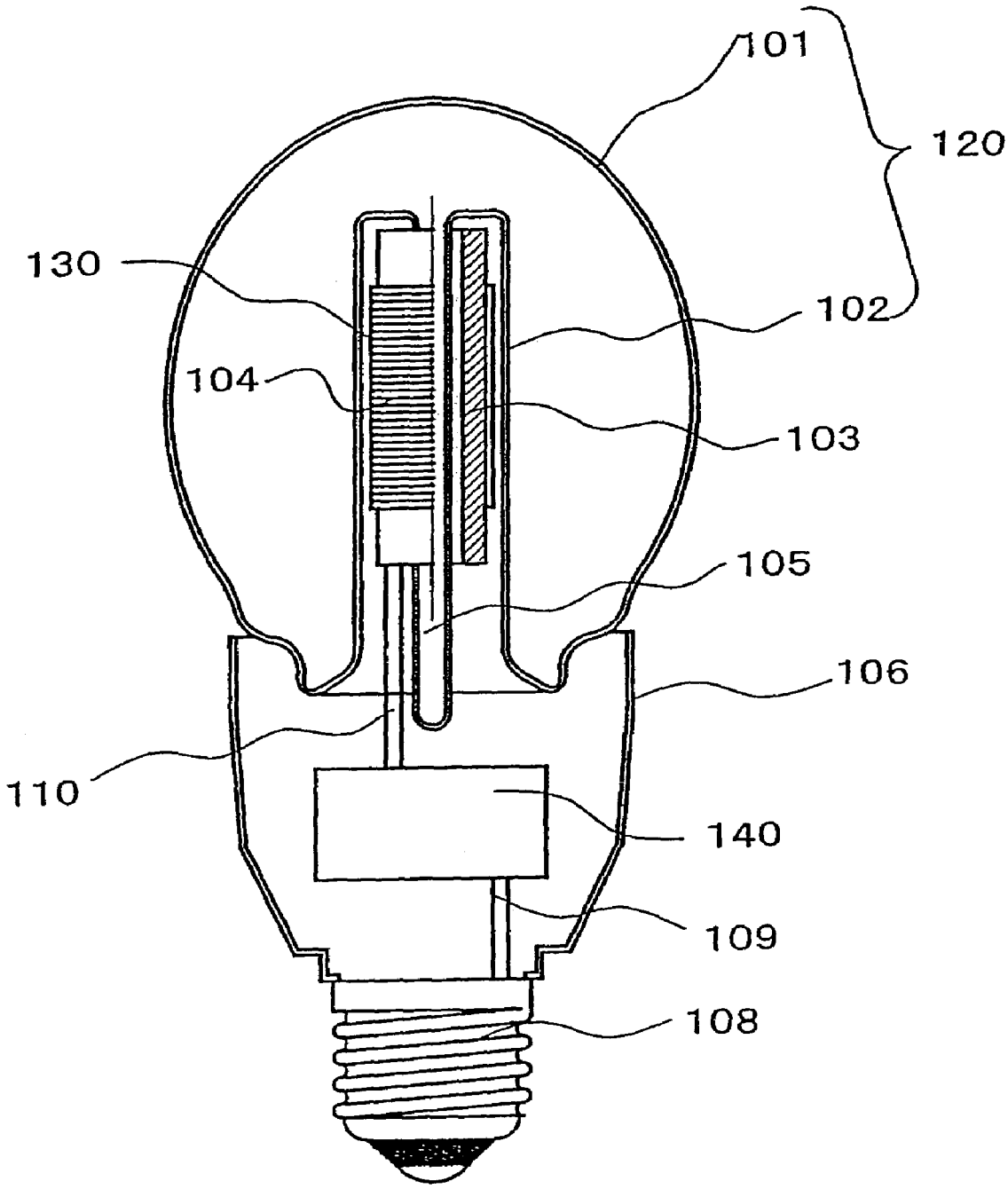
FIG. 6 is a cross-sectional view schematically illustrating a configuration of a self-ballasted electrodeless fluorescent lamp according to an embodiment of the present invention.

FIG. 6 schematically illustrates a configuration of an electrodeless discharge lamp operating device according to the embodiment of the present invention. In order to facilitate the understanding of the configuration, FIG. 6 shows both the cross section of the discharge bulb 120 and that of the core 103. Note that like elements to those already illustrated in FIG. 1 will be give like reference numerals and will not be further described below.

The electrodeless discharge lamp operating device of the present embodiment includes the light-transmitting discharge bulb 120, an induction coil (103, 104) for generating an electromagnetic field inside the discharge bulb 120, and a ballast circuit 140 for supplying a high-frequency power to the induction coil. The operating frequency of the ballast circuit 140 is in the range of 80 kHz to 500 kHz. Where the operating frequency of the ballast circuit 140 is f (kHz) and the power input to the discharge bulb 120 is P (W), the pressure p (Pa) of the rare gas in the discharge bulb 120 satisfies the following relationship:

$$p \geq \sqrt{\frac{A}{P - \frac{B}{f^2} - C}}$$ [Expression 1]

(where A, B and C are constants having the following values: $A=4.0\times10^4$, $B=3.5\times10^4$ and $C=6.2$), and the power input P to the discharge bulb 120 is 7 W at minimum and 22 W at maximum. The inside of the discharge bulb 120 is filled with a rare gas including at least krypton and mercury, and the induction coil including the core (103) and the winding 104 is inserted into a cavity portion provided in a portion of the discharge bulb 120.

The electrodeless discharge lamp operating device illustrated in FIG. 6 is a so-called "self-ballasted electrodeless fluorescent lamp". The self-ballasted electrodeless fluorescent lamp includes a case 106 supporting the discharge bulb 120 including the induction coil 130 therein and made of an insulative plastic material for accommodating the ballast circuit 140, and further includes a base 108 so that the electrodeless discharge lamp operating device can be connected to a incandescent-lamp socket for receiving power supply. As illustrated in FIG. 6, the overall shape is an incandescent-lamp shape.

The discharge bulb 120 includes the outer tube 101 and the inner tube 102. In the present embodiment, the discharge bulb 120 is filled with mercury and a krypton gas, and the inner surface of the discharge bulb 120 is coated with a phosphor (not shown). Moreover, the exahust tube 105 is connected to the inner tube 102.

The induction coil 130 is provided between the inner tube 102 of the discharge bulb 120 and the exahust tube 105 for supplying an electromagnetic energy for generating a discharge plasma inside the discharge bulb 120. The induction coil 130 has a generally tubular shape (length: about 20 mm), and is formed by the winding 104 around the core 103. The inductance of the induction coil 130 is about 120 (μH). Moreover, an Mn—Zn ferrite (relative magnetic permeability: about 2300) is used as the material of the core 103. An Mn—Zn ferrite is a ferrite containing iron, manganese and zinc, and the induction coil core 103 made of this ferrite is advantageous in that there is little magnetic loss when the operating frequency of the ballast circuit is set to 80 kHz to 500 kHz.

Figure 7:
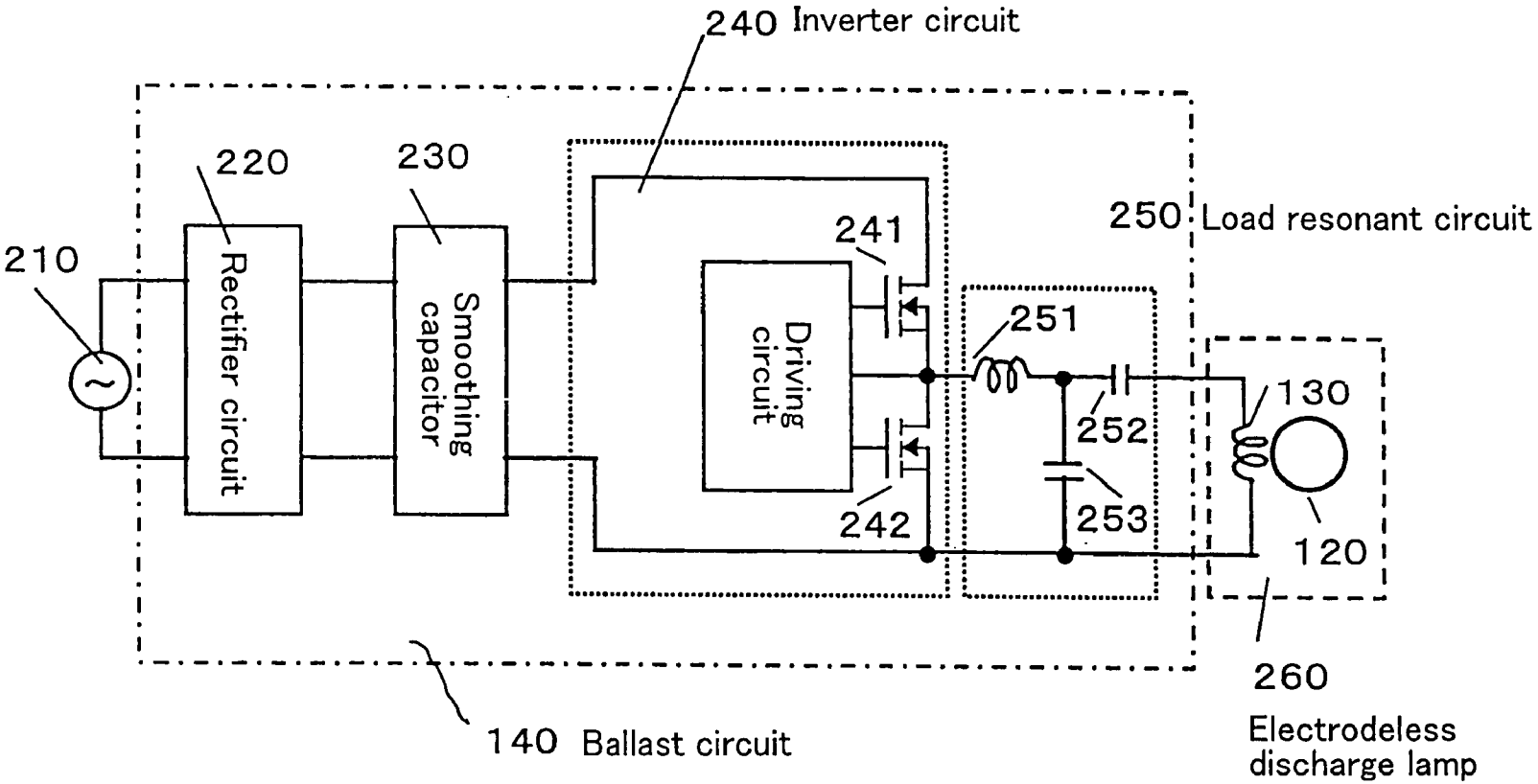
FIG. 7 is a diagram illustrating a configuration of a ballast circuit for a self-ballasted electrodeless fluorescent lamp according to an embodiment of the present invention.

The ballast circuit 140 for supplying a high-frequency power to the induction coil 130 includes electronic components forming the ballast circuit, such as semiconductor devices (e.g., transistors), capacitors, resistors, inductors, etc., and a printed wiring board (not shown) on which these electronic components are arranged. The ballast circuit 140 may have a circuit configuration as illustrated in FIG. 7, for example.

Specifically, the ballast circuit 140 may include a rectifier circuit 220 electrically connected to a power supply (e.g., a commercial power supply) 210, a smoothing capacitor 230, an inverter circuit 240 and a load resonant circuit 250. The inverter circuit 240 includes switching devices 241 and 242 and a driving circuit for driving the switching devices 241 and 242, and the load resonant circuit 250 includes an inductor 251 and capacitors 252 and 253.

The operation of the ballast circuit 140 will be briefly described below. First, an alternating current from the commercial power supply 210 is rectified at the rectifier circuit 220, and then smoothed at the electrolytic capacitor (smoothing capacitor) 230. The output of the electrolytic capacitor 230 is converted to a high-frequency current at the inverter circuit 240, and a high-frequency power is supplied to the discharge bulb 120 via the load resonant circuit 250.

With the self-ballasted electrodeless fluorescent lamp of the present embodiment, a light output equivalent to that of an incandescent lamp of 60 W can be obtained. When designing the self-ballasted electrodeless fluorescent lamp, the power input P to the discharge bulb 120 was set to 10 W (the rated power including the power loss at the ballast circuit was 11 W). The frequency of the high-frequency power supplied to the discharge bulb 120, i.e., the operating frequency f of the ballast circuit 140, was set to 400 kHz. Under such a condition, the required pressure p of the krypton fill gas was obtained.

Where the operating frequency f of the self-ballasted electrodeless fluorescent lamp is 400 kHz and the power input P to the discharge bulb is 10 W, the krypton gas pressure p (Pa) required for maintaining a stable discharge may be a pressure p that satisfies Expression 1, as described above.

Note however that with an actual electrodeless discharge lamp operating device, the power input to the discharge bulb 120 may be lower than the rated power input due to various factors, such as the fluctuation of the voltage supplied from the commercial power supply 210, the coupling loss caused by an external metal lighting fixture being in close vicinity, and the decrease over time in the capacitance of the electrolytic capacitor used as the smoothing capacitor 230 for smoothing a current in the ballast circuit 140. Taking these factors into consideration, when actually designing an electrodeless discharge lamp operating device, it is preferred that the rare gas pressure is determined so that a plasma discharge in the discharge bulb can be maintained even when the power input to the discharge bulb becomes smaller (e.g., 70%) than the rated power input, in view of actual use of the device. Therefore, it is a safer design to obtain the pressure p by using a value that is 70% of the rated power input P to the discharge lamp as the value of the pressure p required for the krypton gas in Expression 3 above.

Using f=400 (kHz) and P=10×0.7 (W) in Expression 1, the minimum pressure $p_{min}$ required for the krypton gas is about 250 (Pa). Therefore, in the self-ballasted electrodeless fluorescent lamp of the present embodiment, the pressure p of the krypton gas may be set to about 250 (Pa) or more. Similarly, where the power input P to the discharge bulb 120 is set to 18 W (where the rated power including the power loss of the ballast circuit is set to 20 W) when designing the device in order to obtain a light output equivalent to that of an incandescent lamp of 100 W, the pressure p of the krypton gas may be set to about 80 (Pa) or more.

On the other hand, it is important in determining a krypton gas pressure to make the efficiency of the electrodeless discharge lamp operating device as high as possible. In view of this, the present inventors produced prototypes of self-ballasted electrodeless discharge lamps in which the power input to the discharge bulb is 10 W to 20 W, and conducted experiments on the efficiency thereof.

The results indicated that for 20 W, the efficiency of the self-ballasted electrodeless fluorescent lamp was highest when the krypton gas pressure was set to about 50 (Pa) and, for 10 W, it was difficult to maintain a discharge when the krypton gas pressure was 100 Pa or less, with the efficiency decreasing as the pressure was increased. In either case, the highest efficiency point exists in an area below the above-described rare gas pressure determined while taking into consideration the power fluctuation. Therefore, it is preferred that the rare gas is filled at the lowest possible pressure with which a discharge can be maintained.

Figure 8:
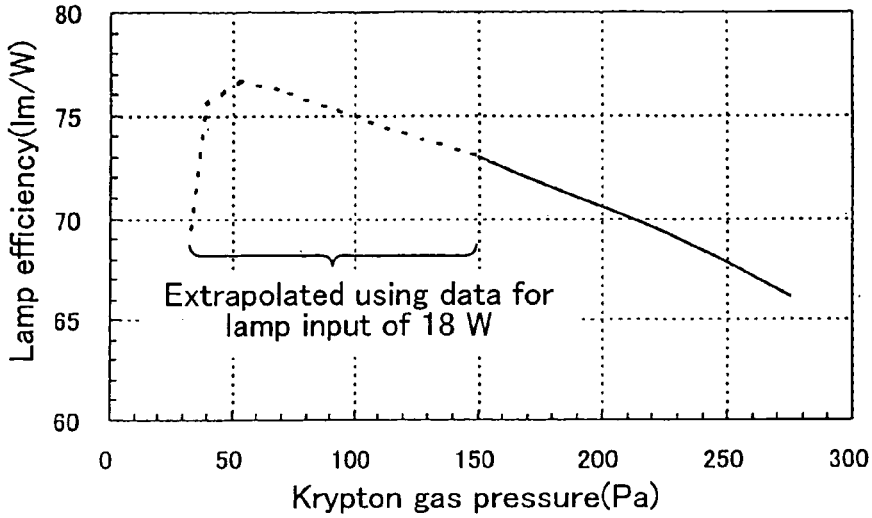
FIG. 8 shows the relationship between the krypton gas pressure and the lamp efficiency of a self-ballasted electrodeless fluorescent lamp according to an embodiment of the present invention.

This will now be discussed in greater detail based on the results of one experiment shown in FIG. 8. The experimental results shown in FIG. 8 are those obtained under a condition where the lamp input was 10 W and the operating frequency was 400 kHz. Since the lamp input is as low as 10 W, it is not possible to maintain a stable discharge if the gas pressure is 150 Pa or less. Therefore, in FIG. 8, the portion in the area of 150 Pa or less, denoted by a broken line, is obtained by extrapolation using data for a lamp input of 18 W.

As shown in FIG. 8, under a condition where 100% krypton is used, the lamp input is 10 W and the operating frequency is 400 kHz, the efficiency is highest at a gas pressure of about 50 Pa, and the efficiency decreases rapidly for pressure values below the gas pressure and decreases gradually for pressure values above the gas pressure. This is because in a lower-pressure area, electrons move more easily, thereby increasing the loss (diffusion loss) in which electrons are taken by the tube wall, thus decreasing the efficiency and, in a higher-pressure area, the loss due to elastic scattering, which does not contribute to the light emission, increases, thus decreasing the efficiency.

While the efficiency is highest at a gas pressure of about 50 Pa as described above, a stable discharge cannot be maintained at such a gas pressure. Therefore, in a gas pressure range where a stable discharge can be maintained, the efficiency is higher as the pressure is lower. As described above, a gas pressure of 250 Pa or more is required when a margin is provided taking into consideration the fluctuation of the power supply voltage, the decrease in the power due to degradation of circuit elements, and variations in the gas pressure during the manufacturing process. Taking both of these into consideration, an optimal design value is 250 Pa under the condition of this experiment.

Taking the above into consideration, in the present embodiment, the pressure of the krypton fill gas is set to 250 (Pa) to be on the safer side with respect to the gas pressure. Note that the present inventors have actually produced prototypes of the electrodeless discharge lamp operating device of the present embodiment, and confirmed that a stable discharge can be maintained without flickering.

As described above, in the electrodeless discharge lamp device of the present embodiment, the pressure of krypton gas filled in the bulb was set to about 250 (Pa). Note that Japanese Laid-Open Patent Publication No. 55-60260 discloses a condition of 0.1 to 5 mmHg (about 13 to about 670 Pa) for the partial pressure of the krypton gas filled in an electrodeless fluorescent lamp where the operating frequency of the ballast circuit is set to about 10 MHz. However, the operating frequency of the ballast circuit as disclosed in this publication is totally different from that of the electrodeless discharge lamp device of the present embodiment, indicating that the technical concept of the publication is basically significantly different from that of the present invention. Moreover, in Japanese Laid-Open Patent Publication No. 55-60260, the krypton gas pressure is determined from a point of view of obtaining a level of startability similar to that obtained with an argon gas, and the publication fails to describe maintaining a stable discharge. In addition, the startability of an electrodeless discharge lamp and the discharge stability thereof are different from each other in terms of the discharge mechanism, and experimental results on the startability does not dictate the discharge stability condition.

Note that with the configuration of the present embodiment, the power input $P_{min}$ (W) to the discharge bulb required for maintaining a discharge generally decreases as the operating frequency f (kHz) increases. However, because changing the operating frequency f (kHz) to a frequency in the MHz range not only makes the driver for driving the inverter circuit more expensive, but also complicates the electromagnetic interference (EMI) countermeasure, a range of 80 to 500 (kHz) is preferably used.

Next, the operation of the self-ballasted electrodeless fluorescent lamp of the present embodiment will be briefly described below. When a commercial alternating-current power is supplied to the ballast circuit 140 via the base 108, the ballast circuit 140 converts the commercial alternating-current power to a high-frequency alternating-current power and supplies the converted power to the winding 130. The frequency of the alternating current supplied by the ballast circuit 140 is, for example, 80 to 500 kHz, as described above, and the supplied power is, for example, 7 to 22 W. Receiving the supply of a high-frequency alternating-current power, the winding 130 forms a high-frequency alternating magnet field in the space therearound. Then, an induced electric field is produced so as to be perpendicular to the high-frequency alternating magnet field, and the light-emitting gas inside the discharge bulb 120 is excited to emit light, thereby obtaining light emission in the ultraviolet range or the visible range. Light emission in the ultraviolet range is converted by a phosphor (not shown) formed on the inner wall of the discharge bulb 120 to light emission in the visible range (visible light). Note that a lamp may be provided without the phosphor so that light emission in the ultraviolet range (or light emission in the visible range) is used as it is. Light emission in the ultraviolet range is produced primarily from mercury. More specifically, when a high-frequency current is passed through the induction coil (103, 104) brought into the vicinity of the discharge bulb 120, an induced electric field formed by electromagnetically-induced lines of magnetic force causes mercury atoms and electrons in the discharge bulb 120 collide with each other, thereby obtaining an ultraviolet radiation from the excited mercury atoms.

The frequency of the alternating current supplied from the ballast circuit 140 will now be further described. In the present embodiment, the frequency of the alternating current supplied from the ballast circuit 140 is in a relatively low frequency range of 1 MHz or less (e.g., 80 to 500 kHz), as compared with 13.56 MHz, being an ISM band, or a few MHz, which are commonly used in practice. The reason for using a frequency in the low frequency range is as follows. First, if the device is operated in a relatively high range such as 13.56 MHz or a few MHz, there is required a large-sized noise filter for suppressing the line noise from the ballast circuit 140, thus increasing the volume of the ballast circuit 140. Moreover, since very strict regulations are imposed by laws on high-frequency noise, if noise radiated or propagated from the lamp is high-frequency noise, it is necessary to provide an expensive shield in order to observe the regulations, which presents a significant hindrance to reducing the cost. If the device is operated in a frequency range of about 80 kHz to 500 MHz, inexpensive, commonly-available components used as electronic components in common electronic appliances can be used as members forming the ballast circuit 140, and small-sized members can be used, whereby it is possible to reduce the cost and the size, thus providing a significant advantage.

Note that in a self-ballasted electrodeless fluorescent lamp or an electrodeless discharge lamp operating device in which the operating frequency is set to 80 kHz to 500 kHz, if the krypton gas pressure exceeds 350 Pa, the starting voltage of the lamp increases so much that it is difficult to start operating the lamp. Therefore, in view of the startability, it is preferred that the upper limit of the krypton gas is 350 Pa.

Where the low-wattage electrodeless discharge lamp operating device or the low-wattage self-ballasted electrodeless fluorescent lamp of the present embodiment is operated by being connected to a commercial power supply, it is possible to prevent a discharge from being unstable or discontinued even if the power supply voltage fluctuates or the capacitance of the electrolytic capacitor decreases. As a result, a stable discharge can be maintained.

The configuration of the present embodiment is not limited to the example illustrated above, but may be modified. For example, while a 100(%) krypton gas is used in the above example, a mixed gas including argon or xenon in addition to krypton may be used. When xenon is mixed in, the power input to the discharge bulb required for maintaining a discharge is smaller than that with 100(%) krypton. Mixing in argon was experimented in greater detail as follows.

Figure 9:
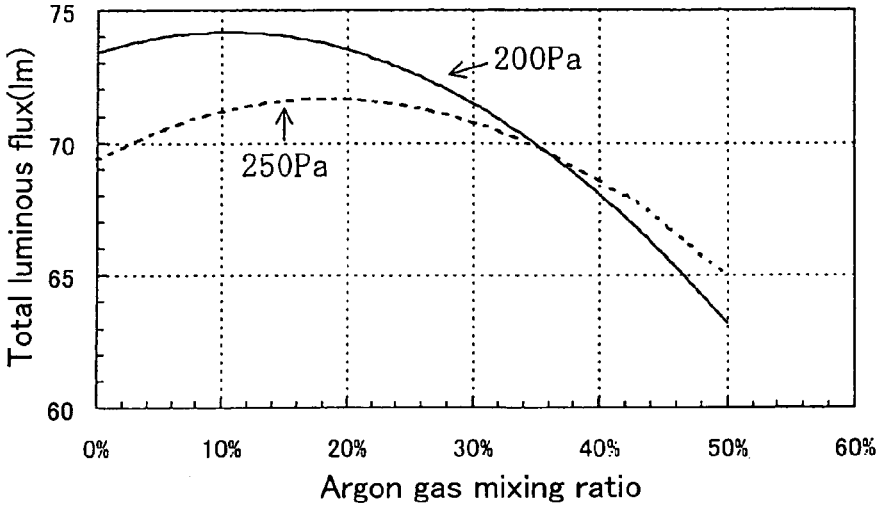
FIG. 9 shows the relationship between the argon gas mixing ratio and the total luminous flux in a self-ballasted electrodeless fluorescent lamp according to an embodiment of the present invention.

First, a research on the lamp efficiency will be described. As shown in FIG. 9, an examination was made as to how the lamp efficiency changes when the mixing ratio (partial pressure ratio) between a krypton gas and an argon gas is varied while fixing the total gas pressure to 200 Pa and 250 Pa. The conditions include a lamp input of 11 W, and an operating frequency of 480 kHz.

Where the total gas pressure was 200 Pa, the maximum value of the total luminous flux (an indicator of the lamp efficiency) is obtained when the argon gas is mixed in to a proportion of about 10%, and the total luminous flux decreases rapidly if the argon gas mixing ratio exceeds 20%. Therefore, in this case, the argon gas mixing ratio is preferably 20% or less. Note that in the range of 0 to 20%, the total luminous flux does not change substantially.

On the other hand, where the total gas pressure is 250 Pa, the maximum value of the total luminous flux is obtained when the argon gas is mixed in to a proportion of about 20%, and the total luminous flux decreases rapidly if the argon gas mixing ratio is lower than 10% or higher than 30%.

In order to obtain a high lamp efficiency when the total gas pressure is 200 to 250 Pa, taking into consideration variations in the total gas pressure during the manufacturing process, etc., the argon mixing ratio is preferably 10 to 30% according to the results above.

Next, a research on the running-up of a lamp lighting will be described. For example, where the total gas pressure is 200 Pa, mixing in an argon gas is advantageous in that the brightness running-up after the starting is improved although the lamp efficiency during the stable operating period is not improved substantially, as shown in FIG. 9.

Figure 10:
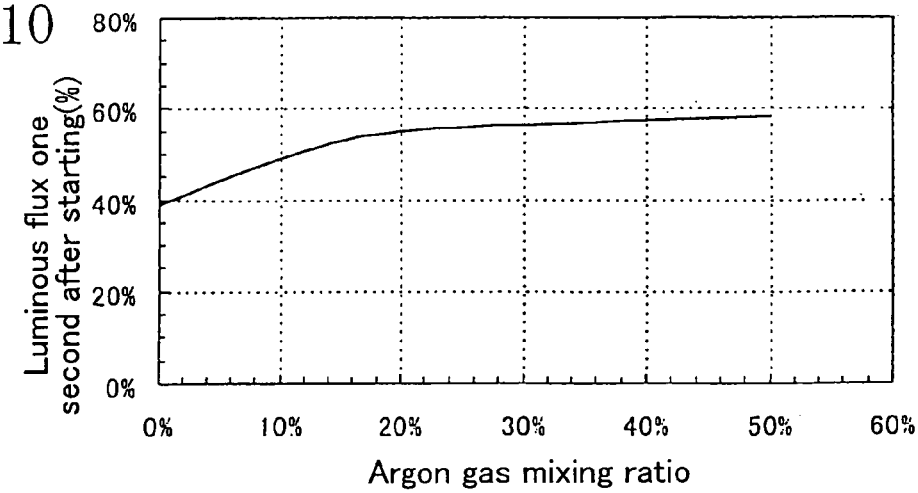
FIG. 10 shows the relationship between the argon gas mixing ratio and the luminous flux one second after the starting in a self-ballasted electrodeless fluorescent lamp according to an embodiment of the present invention.

FIG. 10 shows how the proportion of the luminous flux one second after the starting to that during the stable operating period (an indicator of the running-up characteristics) changes when the mixing ratio (partial pressure ratio) between a krypton gas and an argon gas is varied under a condition where the lamp input is 11 W, the operating frequency is 480 kHz and the total gas pressure is 200 Pa.

As shown in FIG. 10, in the argon gas mixing ratio range of 0% to 50%, the luminous flux one second after the starting increases as the argon gas mixing ratio is increased. This is because an argon gas has a higher ion voltage than a krypton gas, thereby increasing the lamp impedance immediately after the starting (where the discharge bulb is cool and there is little mercury vapor), making it more likely that the power is input at a higher level. Note that if the argon gas mixing ratio exceeds 20%, the luminous flux one second after the starting does not increase significantly.

Based on the researches on the lamp efficiency and the running-up characteristics as described above, the argon gas mixing ratio is preferably 10% or more and 50% or less. Moreover, if the argon gas mixing ratio is 50% or less, there is substantially no divergence from Expression 5. If the mixing ratio exceeds 50%, the power input to the discharge bulb required for maintaining a discharge becomes higher than that obtained with 100(%) krypton. Also for these reasons, it is preferred that the argon gas mixing ratio is 10% or more and 50% or less.

With the self-ballasted electrodeless fluorescent lamp of the present embodiment, the shape of the electrodeless discharge lamp 260 is an incandescent-lamp shape. However, the shape may of course be any other suitable shape such as a spherical shape or a tubular shape. Moreover, while the self-ballasted electrodeless fluorescent lamp has an outer tube diameter D1 of 65 mm and an inner tube diameter D2 of 25.5: mm in the present embodiment, similar effects can be obtained also when the diameter D1 of the outer tube is set in a range of 55 to 95 mm and the outer diameter D2 of the inner tube is set in a range of 20 to 30 mm. Moreover, while the number of turns of the winding 104 is 66 in the present embodiment, the number of turns may be 30 to 70.

When the self-ballasted electrodeless fluorescent lamp is in the lamp discharge period, if the temperature of the core 103 of the induction coil 130 increases so that the temperature of the magnetic material used as the core 103 exceeds a certain critical temperature (the Curie temperature), the magnetic permeability decreases, and the discharge may be discontinued. A heat radiating structure for preventing such an event may be employed, e.g., a structure as disclosed in Japanese Utility Model Publication for Opposition No. 6-6448, i.e., a structure including a rod-shaped heat conducting material (made of copper) inserted into a tubular core, and a plate connected to one end of the heat conducting material, with the plate being brought into contact with the lamp case (jacket) so as to release heat to the outside. Moreover, a heat radiating structure for preventing shortening of the lifetime due to the increase in the temperature of the electrolytic capacitor 230 used in the ballast circuit may be employed, e.g., a structure as disclosed in Japanese Laid-Open Patent Publication No. 10-112292, i.e., a structure including a heat insulating structure between the discharge bulb and the electrolytic capacitor so that heat from the discharge bulb side is not transferred to the electrolytic capacitor.

In addition, while the exahust tube 105 is provided inside the core 103 of the induction coil 130 in the electrodeless discharge lamp of the present embodiment, the exahust tube 105 may be attached to any other suitable location. For example, it may be attached to a tip portion of the outer tube 101 and pinch-sealed. Moreover, while the inner surface of the discharge bulb 120 is coated with a phosphor in the self-ballasted electrodeless fluorescent lamp of the present embodiment, the phosphor is not limited to those for general lighting, but may alternatively be a phosphor emitting an action spectrum for an erythemal effect or a phosphor emitting a plant-growing action spectrum. Note that no phosphor coating may be used as described above so as to utilize a germicidal effect by an ultraviolet radiation.

Furthermore, if the self-ballasted electrodeless fluorescent lamp of the present embodiment is coated with a monochromatic phosphor such as a $Y_2O_2$:Eu phosphor (red), a $CeMgAl_{11}O_{19}$:Tb phosphor (green) or a $BaMg_2Al_{16}O_{27}$:$Eu^{2+}$ phosphor (blue), it may be used as a replacement for an incandescent lamp of a display device.

While the present embodiment is directed to a self-ballasted electrodeless fluorescent lamp including a discharge bulb, a ballast circuit and a base integrated as one unit, the present invention can similarly be carried out with an electrodeless discharge lamp operating device in which the ballast circuit is separately provided from the discharge bulb.

According to the present invention, the operating frequency of the ballast circuit is in the range of 80 kHz to 500 kHz, and where the operating frequency of the ballast circuit is f (kHz), and the power input to the discharge bulb is P (W), the pressure p (Pa) of the rare gas in the discharge bulb satisfies the relationship of the following expression:

$$p \geq \sqrt{\frac{A}{P - \frac{B}{f^2} - C}} \qquad \text{[Expression 1]}$$

(where A, B and C are constants having the following values: $A=4.0\times10^4$, $B=3.5\times10^4$ and $C=6.2$), and the power input P to the discharge bulb is 7 W at minimum and 22 W at maximum, whereby it is possible to prevent a discharge from being unstable or discontinued, thus maintaining a stable discharge.

INDUSTRIAL APPLICABILITY

The electrodeless low-pressure discharge lamp operating device and the self-ballasted electrodeless fluorescent lamp of the present invention have a high industrial applicability in that they are useful as industrial and household lighting and, particularly, they can be used stably over a long period of time and can be used with a small power consumption when used as an incandescent lamp replacement.

The invention claimed is:

1. An electrodeless low-pressure discharge lamp operating device, comprising:

a light-transmitting discharge bulb filled with a rare gas including at least krypton and mercury;

an induction coil including a core and a coil wound around the core for generating an electromagnetic field inside the discharge bulb; and a ballast circuit for supplying a high-frequency power to the induction coil, wherein:

an operating frequency of the ballast circuit is in a range of 80 kHz to 500 kHz, and where the operating frequency of the ballast circuit is f (kHz) and a power input to the discharge bulb is P (W), a pressure p (Pa) of the rare gas in the discharge bulb satisfies a relationship of a following expression:

$$p \geq \sqrt{\frac{A}{P - \frac{B}{f^2} - C}} \qquad \text{[Expression 1]}$$

where A, B and C are constants having the following values: $A=4.0\times10^4$, $B=3.5\times10^4$ and $C=6.2$; and the power input P to the discharge bulb is 7 W at minimum and 22 W at maximum.

2. The electrodeless low-pressure discharge lamp operating device of claim 1, wherein the core of the induction coil contains iron, manganese and zinc.

3. The electrodeless low-pressure discharge lamp operating device of claim 1 or 2, wherein:

the rare gas filled in the discharge bulb includes argon; and the argon is 10% or more and 50% or less of the rare gas.

4. A self-ballasted electrodeless fluorescent lamp, comprising:

a light-transmitting discharge bulb filled with a rare gas including at least krypton and mercury;

an induction coil including a core and a coil wound around the core and being inserted into a cavity portion provided in a portion of the discharge bulb;

a ballast circuit for supplying a high-frequency power to the induction coil; and a base electrically connected to the ballast circuit, wherein:

an operating frequency of the ballast circuit is in a range of 80 kHz to 500 kHz, and where the operating frequency of the ballast circuit is f (kHz) and a power input to the discharge bulb is P (W), a pressure p (Pa) of the rare gas in the discharge bulb satisfies a relationship of a following expression:

$$p \geq \sqrt{\frac{A}{P - \frac{B}{f^2} - C}} \quad \text{[Expression 1]}$$

where A, B and C are constants having the following values: $A=4.0\times10^4$, $B=3.5\times10^4$ and $C=6.2$; and the power input P to the discharge bulb is 7 W at minimum and 22 W at maximum.

5. The self-ballasted electrodeless fluorescent lamp of claim 4, wherein the core of the induction coil contains iron, manganese and zinc.

6. The self-ballasted electrodeless fluorescent lamp of claim 4 or 5, wherein:

the rare gas filled in the discharge bulb includes argon; and the argon is 10% or more and 50% or less of the rare gas.

7. The electrodeless low-pressure discharge lamp operating device of claim 1, wherein a maximum value of the power input P is 13 W or less.

8. The self-ballasted electrodeless fluorescent lamp of claim 4, wherein a maximum value of the power input P is 13 W or less.

* * * * *